United States Patent [19]

Huang et al.

[11] Patent Number: 4,763,831

[45] Date of Patent: Aug. 16, 1988

[54] VARIABLE LENGTH/WIDTH PACKAGING BOX

[76] Inventors: Ming Y. Huang, No.63, Ta Hsing Street; Men Y. Huang, No.67, Ta Hsing Street, both of Tainan, Taiwan

[21] Appl. No.: 75,895

[22] Filed: Jul. 21, 1987

[51] Int. Cl.[4] ..... B65D 5/42

[52] U.S. Cl. ..... 229/101; 229/49; 229/198

[58] Field of Search ..... 229/16 R, 101, 198, 229/49, 6 R

[56] References Cited

U.S. PATENT DOCUMENTS

| | | | |
|---|---|---|---|
| 3,223,309 | 12/1965 | Chiorri | 229/49 |
| 3,226,008 | 12/1965 | Chiorri | 229/49 |
| 3,598,303 | 8/1971 | Folz | 229/101 |
| 4,210,274 | 7/1980 | Leonard | 229/49 |

FOREIGN PATENT DOCUMENTS

| | | | |
|---|---|---|---|
| 97022 | 12/1983 | European Pat. Off. | 229/16 R |
| 6414084 | 6/1966 | Netherlands | 229/49 |
| 1029562 | 5/1966 | United Kingdom | 229/16 R |

*Primary Examiner*—Stephen Marcus
*Assistant Examiner*—Gary E. Elkins
*Attorney, Agent, or Firm*—Morton J. Rosenberg

[57] ABSTRACT

A packaging box comprising a base plate and four engagement elements which are disposed at the corners of the base plate. The base plate includes a plurality of longitudinal and transverse grooves squarely intersecting with each other to form a plurality of squares. The base plate can be cut into a desired size along the grooves. Each engagement element includes a first portion, a second portion and a separation rib which is disposed at the junction sections of the first and second portions to form right angle bends. Each of the first and second portion is disposed in parallel with an inner plate and an outer plate. A hollow space is formed between the inner and outer plates to allow the edges of the base plate inserted thereinto. Each outer plate has a ridge edge inwardly extending for the outer end to engage with the grooves of the base plate.

1 Claim, 2 Drawing Sheets

VARIABLE LENGTH/WIDTH PACKAGING BOX

BACKGROUND OF THE INVENTION

The present invention relates to a packaging box which can be easily assembled to form a desired size in accordance with packaged articles.

Many articles need to be packaged in boxes. Since each article or set of articles has its own specific size and shape, the box which contains the article(s) must have an appropriate size to be used therewith. The shape and size of conventional boxes are unchangeable; therefore it is necessary for the user to prepare several boxes having various sizes to be used for packaging the articles. Therefore, it is uneconomical and inconvenient for using and manufacturing the packaging boxes.

It is the purpose of the present invention therefore, to mitigate and/or obviate the abovementioned drawbacks in the manner set forth in the detailed description of the preferred embodiment.

SUMMARY OF THE INVENTION

A primary objective of the present invention is to provide a packaging box which can be easily assembled and disassembled.

Another objective of the present invention is to provide a packaging box which includes a base plate having a plurality of horizontal grooves and vertical grooves so that the base plate can be easily cut into a desired area to form a packaging box with desired size.

A further objective of the present invention is to provide a packaging box which includes four engagement elements, each of which has two hollow spaces to allow the ends of the base plate to be inserted thereinto and two ridge edges at outer ends to engage with the grooves of the base plate.

Further objectives and advantages of the present invention will become apparent at the following description, and the features of novelty which charactize the invention be pointed out with particularity in the claims annexed to and forming a part of this invention.

DETAILED DESCRIPTION OF THE PREFERRED EMBODIMENT

Figure 1:
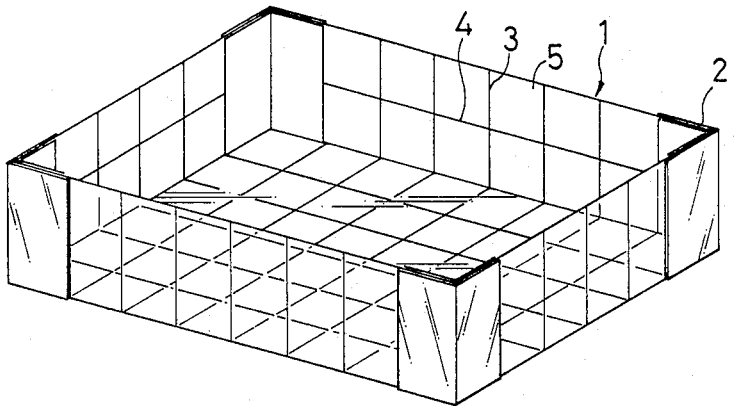
FIG. 1 is a perspective view of a packaging box in accordance with the present invention.
Figure 2:
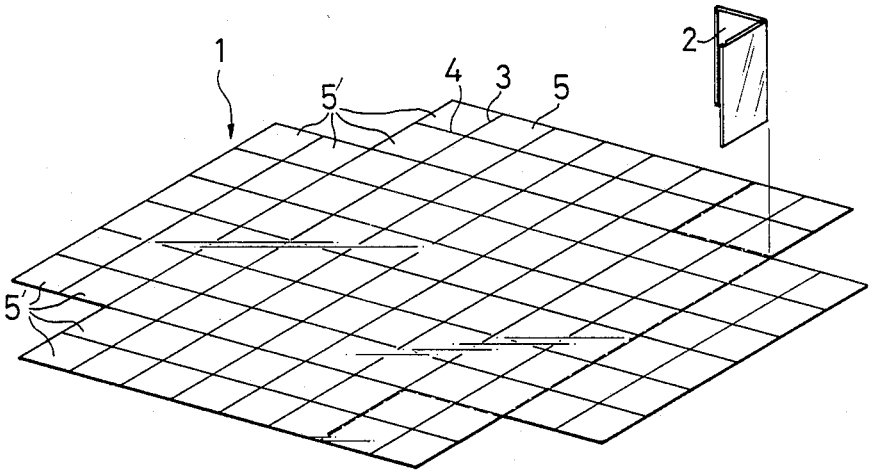
FIG. 2 is an exploded view of the packaging box of FIG. 1 with the base plate being unfolded and with only one engagement element being shown.

Referring to FIGS. 1 and 2, it can be seen that a packaging box in accordance with the present invention comprises a base plate 1 and four identical engagement elements 2 disposed at the corners of the packaging box.

The base plate 1 comprises a plurality of longitudinal grooves 3 and transverse grooves 4. The longitudinal grooves 3 squarely intersect with (i.e. are perpendicular with) the transverse grooves 4 to form a plurality of squares 5 on the base plate 1. A user may easily cut the four corners of the base plate 1 away as shown in FIG. 2. If a box of shorter length (or width) should be required, the user would simply cut along the grooves as indicated by way of example in dotted lines in FIG. 2. Furthermore, the base plate 1 may be easily bent along the longitudinal and transverse grooves 3 and 4 so as to essentially form the shape of the packaging box and so as to allow the squares 5' adjacent to the cutout sections of said base plate 1 to be engaged with the engagement elements 2 at each corner.

Figure 4:
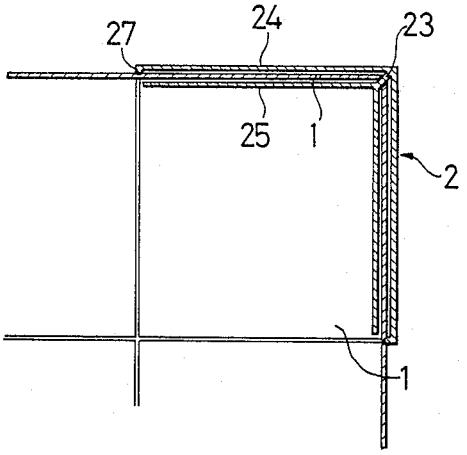
FIG. 4 is an enlarged cross-section view of a corner of the packaging box of FIG. 1 to show the engagement element engaging with the base plate.
Figure 3:
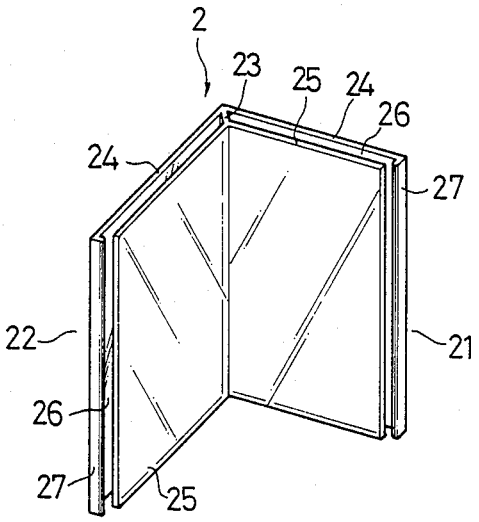
FIG. 3 is an enlarged perspective view of the engagement element of the packaging box of FIG. 1.

Turning to FIGS. 3 and 4, one of the four engagement elements 2, which are all identical in structure, can be seen. The engagement element 2 comprises a first portion 21, a second portion 22 and a separation rib 23. The separation rib 23 is disposed at the junction of the first and second portions, 21 and 22, so that the first and second portions are connected by and are symmetrical about the separation rib 23. The first and second portions, 21 and 22, are identical and form right angle bends, being supported and spaced apart by the separation rib 23. Each of the first and second portions, 21 and 22, includes an outer plate 24 and an inner plate 25 in parallel therewith. A hollow space 26 is formed between the inner and outer plates, 25 and 24, so as to be engageable with the base plate 1 has been folded into the form of a packaging box. The outer end of each outer plate 24 has a ridge edge 27 projecting from the outer plate towards the end of the inner plate 25, so that the ridge edges 27 can be engaged with the grooves 3 or 4 as shown in FIG. 4 to form a packaging box.

Since the base plate 1 can be easily cut along the grooves, 3 and 4, it is possible for the user to manufacture a packaging box according to the desired size. Furthermore, the packaging box can be easily assembled and disassembled due to the easy engagement of the ridge edges 27 and grooves, 3 and 4.

As various possible embodiments might be made of the above invention without departing from the scope of the invention, it is to be understood that all matter herein described or shown in the accompanying drawings is to be interpreted as illustrative and not in a limiting sense. Thus it will be appreciated that the drawings are exemplary of a preferred embodiment of the invention and that the scope of the invention is intended to be limited only by the scope of the appended claims.

I claim:

1. A variable length/width packaging box comprising:

(a) a substantially planar base plate defining four corners and having a plurality of longitudinal grooves and transverse grooves formed therein, said longitudinal and transverse grooves intersecting with each other to form a plurality of squares on said base plate, said base plate being severable along said longitudinal and transverse grooves to form a cutout section at respective corners of said base plate;

(b) four engagement elements which are engageable respectively at said corners of said base plate after said base plate is folded into a packaging box form, each of said engagement elements including a first portion, a second portion and a separation rib; said separation rib disposed at a junction of said first and second portions of each of said engagement elements; said engagement elements forming substantially continuous right angle bends;

(c) said first and second portions of each of said engagement elements being substantially identical in structure and symmetrical about said separation rib, each of said first and second portions having an outer plate and an inner plate in parallel each to the other; said outer and inner plates being supported and spaced apart by said separation rib;

(d) said outer and inner plates forming a hollow space therebetween in order to allow correspondent squares adjacent to cutout sections of said base plate to be inserted therein; and, (e) each of said outer plates having a ridge edge matching said grooves and being receivable into said grooves of said base plate; said ridge edge projecting from a distal end of said outer plate towards an end of said inner plate.

* * * * *